US007814996B2

(12) United States Patent
Indrupskiy et al.

(10) Patent No.: US 7,814,996 B2
(45) Date of Patent: Oct. 19, 2010

(54) SPIRAL RIBBED ALUMINUM DRILLPIPE

(75) Inventors: David I. Indrupskiy, Moscow (RU); Vladimir S. Basovich, Moscow (RU); Dmitry A. Lubyanyy, Moscow (RU)

(73) Assignee: Aquatic Company, Moscow (RU)

( * ) Notice: Subject to any disclaimer, the term of this patent is extended or adjusted under 35 U.S.C. 154(b) by 106 days.

(21) Appl. No.: 12/103,061

(22) Filed: Apr. 15, 2008

(65) Prior Publication Data

US 2009/0194337 A1 Aug. 6, 2009

Related U.S. Application Data

(60) Provisional application No. 61/025,451, filed on Feb. 1, 2008.

(51) Int. Cl.
*E21B 17/22* (2006.01)

(52) U.S. Cl. ..... 175/323; 175/325.1

(58) Field of Classification Search ..... 175/323, 175/325.3, 325.1, 325.5
See application file for complete search history.

(56) References Cited

U.S. PATENT DOCUMENTS

| | | | | |
|---|---|---|---|---|
| 1,764,769 | A | 6/1930 | Woods | |
| 1,889,866 | A | 12/1932 | Montgomery | |
| 2,715,552 | A * | 8/1955 | Lane | 175/325.5 |
| 3,326,581 | A | 6/1967 | Wong | |
| 3,338,069 | A | 8/1967 | Ortloff | |
| 3,360,846 | A | 1/1968 | Schellstede et al. | |
| 3,360,960 | A * | 1/1968 | Massey | 464/183 |
| 3,563,323 | A | 2/1971 | Edgecombe | |
| 3,784,238 | A | 1/1974 | Chance et al. | |
| 4,460,202 | A | 7/1984 | Chance et al. | |
| 4,496,012 | A | 1/1985 | Savins | |
| 4,674,580 | A | 6/1987 | Schuh et al. | |
| 4,679,637 | A | 7/1987 | Cherrington et al. | |
| 4,754,819 | A | 7/1988 | Dellinger | |
| 4,854,399 | A | 8/1989 | Zijsling | |
| 4,987,961 | A | 1/1991 | McNeely, Jr. | |

(Continued)

FOREIGN PATENT DOCUMENTS

GB 2429723 A 3/2007

(Continued)

OTHER PUBLICATIONS

Aquatic Company, "Light-Alloy Drill Pipes of Improved Dependability (LAIDP)," obtained from http://www.aqua-co.com, generated Jan. 18, 2008.

(Continued)

*Primary Examiner*—William P Neuder
*Assistant Examiner*—Catherine Loikith
(74) *Attorney, Agent, or Firm*—Wong, Cabello, Lutsch, Rutherford & Brucculeri, LLP

(57) ABSTRACT

A spiral ribbed aluminum drillpipe has an intermediate portion with a plurality of ribs spiraling along its length. These ribs have active faces that are exposed by recessed areas. The active faces define incut angles relative to the pipe's outer surface for actively engaging slime/sediment material along a borehole wall. Bearings rotatably disposed on the pipe have a greater diameter than the ribbed intermediate portion or any tool joints on the drillpipe so that the bearings engage the borehole wall. The pipe's body is preferably composed of a lightweight alloy, such as aluminum alloy, whereas the bearings are preferably composed of steel and have wear resistant coating or bands.

23 Claims, 3 Drawing Sheets

U.S. PATENT DOCUMENTS

| | | | | |
|---|---|---|---|---|
| 5,042,600 | A | 8/1991 | Finnegan et al. | |
| 5,069,297 | A | 12/1991 | Krueger et al. | |
| 5,148,876 | A | 9/1992 | Wilson | |
| 5,320,179 | A | 6/1994 | Roos, Jr. et al. | |
| 5,711,386 | A | 1/1998 | Swietlik | |
| 5,937,957 | A * | 8/1999 | Swietlik | 175/323 |
| 6,012,744 | A | 1/2000 | Wilson et al. | |
| 6,056,073 | A * | 5/2000 | Boulet | 175/323 |
| 6,164,380 | A | 12/2000 | Davis | |
| 6,732,821 | B2 * | 5/2004 | Boulet | 175/323 |
| 6,736,224 | B2 | 5/2004 | Kinsella | |
| 2002/0005284 | A1 | 1/2002 | Allen | |
| 2004/0195009 | A1 | 10/2004 | Boulet | |
| 2005/0205251 | A1 | 9/2005 | Tulloch | |

FOREIGN PATENT DOCUMENTS

| | | | |
|---|---|---|---|
| WO | 97/08423 | A1 | 3/1997 |

OTHER PUBLICATIONS

Aquatic Company, "High-Strength Aluminum Alloy Drill Pipes of Improved Dependability," obtained from http://www.aqua-co.com, generated Jan. 18, 2008.

Aquatic Company, Aluminum Tubular Developement, obtained from http://www.aqua-co.com, generated Jan. 18, 2008.

J. Placido, et al., "Fatigue Analysis of Aluminum Drill Pipes," Materials Research, vol. 8, No. 4, pp. 409-415, 2005.

Aquatic Company, Listing of Literature, obtained from http://www.aqua-co.com.

Basovich V.S., Gelfgat M.Ya., Tikhonov V.S., "Drillstring with Aluminum Alloy Pipes Design and Practices," SPE 79873, Proceedings of the 2003 IADC/SPE Drilling Conference, Amsterdam, The Netherlands.

Gelfgat M. Ya., Podrazhansky A. M., Geise J., Paff G. "Stratigrafy drilling in deep water with aluminum drill pipes application", SPE 37597, Proceedings of the 1997 SPE/IADC Drilling Conference, Amsterdam, The Netherlands, Mar. 4-6, 1997.

Akgun F., Maidla, E., Basovich, V., Gelfgat, M., "Why Not Use Aluminum in Drilling," SPE 47823, Proceedings of the 1998 SPE/IADC Drilling Conference, Jakarta, Indonesia, Sep. 7-9, 1998.

M.Y. Gelfgat, V.S. Basovich, A. Adelman, "Aluminum Alloy Tubulars for Oil and Gas Industry," Proceedings of the 2005 SPE Annual Technical Conference and Exhibition, Dallas, Texas, Oct. 9-12, 2005.

M.Y. Gelfgat, V.S. Basovich, A. Adelman, B. Hansen, "Aluminum Alloy Tubulars-Assessment for Ultralong Well Construction," Proceedings of the 2007 SPE Annual Technical Conference and Exhibition, Anaheim, California, Nov. 11-14, 2007.

Mikhail Y. Gelfgat, Vladimir S. Basovich, Alex Adelman, "Aluminum alloy tubulars for the oil and gas industry," World Oil, vol. 227, No. 7, Jul. 2006, obtained from http://www.worldoil.com.

A. I. Bulatov, S. V. Dolgov, "Driller's Guide," Moscow, Nedra, 2006, v1, p. 153, fig, 8.8.

Basovich V.S., Gelfgat M.Ya., Fain G.M. "Current status and prospects of aluminum alloy tubular application in oil and gas industry", Bureniye & Neft (Drilling & Oil), Apr. 2003.

Basovich V.S., Gelfgat M.Ya., Tikhonov V.S., Surkov D.V. "Drillstring design with aluminum drillpipes application for ERD wells", Neft I Kapital—Tekhnologii TEK (Oil & Capital—FuelEnergyComplex technologies), Dec. 2002.

Fain, G. M., Shtamburg, V. F., Danelyants S. M.,—Light-alloy Oil Field Drill Pipes,—M. Nedra publishing house, 1990.

Written English Translation of NPL 1: "A. I. Bulatov, S. V. Dolgov, "Driller's Guide," Moscow, Nedra, 2006, v.1, p. 153, fig.8.8."

Written English Translation of NPL 2: "Basovich V.S., Gelfgat M.Ya., Fain G.M. "Current status and prospects of aluminum alloy tubular application in oil and gas industry", Bureniye & Neft (Drilling & Oil), Apr. 2003."

Written English Translation of NPL 3: Basovich V.S., Gelfgat M.Ya., Tikhonov V.S., Surkov D.V. "Drillstring design with aluminum drillpipes application for ERD wells", Neft I Kapital—Teknologii TEK (Oil & Capital—FuelEnergyComplex technologies), Dec. 2002.

Written English Translation of NPL 4: "Fain, G. M., Shtamburg, V. F., Danelyants S. M.,—Light-alloy Oil Field Drill Pipes,—M. Nedra publishing house, 1990."

International Search Report for corresponding PCT appl. No. PCT/IB2009/005006, dated Aug. 24, 2010.

Written Opinion for corresponding PCT appl. No. PCT/IB2009/005006, dated Aug. 24, 2010.

* cited by examiner

SPIRAL RIBBED ALUMINUM DRILLPIPE

CROSS-REFERENCE TO RELATED APPLICATIONS

This is a non-provisional of U.S. Provisional Application Ser. No. 61/025,451, filed Feb. 1, 2008, which is incorporated herein by reference and to which priority is claimed.

BACKGROUND

Drilling in deviated and horizontal sections of a borehole can cause various problems with slime/sediment accumulation, resistance, and wear. When drilling in greatly inclined sections (e.g., over 65 degrees), for example, drilling mud moves along the top of the borehole above the drillpipe, but the mud fails to transport the slime and sedimentation accumulated on the borehole's lower wall. This type of accumulation also develops when drilling in horizontal sections, especially when the drilling tool operates in a "sliding" mode while correcting the well trajectory.

In addition, the tool joints between pipe sections on the drill string experience resistance against the slime/sediment accumulation when the drill string is moved in the borehole. "Cake" can quickly form at the tool joints as slime/sediment fills in at the joints. This quick caking process may cause hydraulic impact that affects the stability of the borehole walls. Although some of the caked slime/sediment may be dislodged by the mechanical rotation and movement of the drillpipe, full slime removal does not occur. Furthermore, the drillpipe's tool joints can significantly contact the borehole walls in a deviated or horizontal section, causing the joints to experience wear when the drillpipe rotates or moves.

There are steel drillpipes in the prior art that have grooves to reduce the drillpipe's contact with the borehole's wall. Examples of such steel drillpipes are disclosed in A. I. Bulatov, S. V. Dolgov, "Driller's Guide," Moscow, Nedra, 2006, v. 1, p. 153, FIG. 8.8 and in U.S. Pat. No. 4,460,202. Steel drill collars in the prior art may also have grooves, such as disclosed in U.S. Pat. No. 6,012,744. These steel drillpipes and collars, however, can have limited use for drilling highly deviated or horizontal sections of a borehole because the pipe's weight creates high pressing loads that cause higher friction forces while the drillpipe/collar is moving and rotating in the borehole. In addition, the grooves are formed by milling on the outer surface of the steel and are shallow. Grooves machined in this manner do not effectively detach slime/sediment settled on the lower borehole wall.

DETAILED DESCRIPTION

Figure 1:
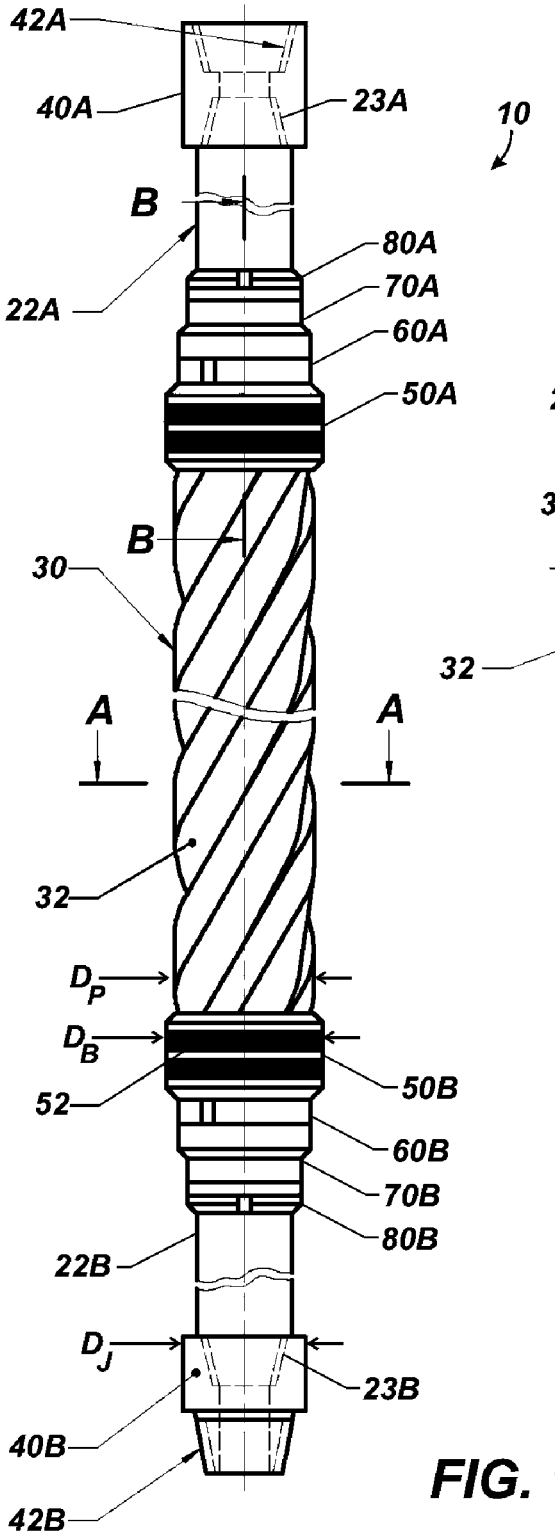
FIG. 1 is an elevational view of a drillpipe according to certain teachings of the present disclosure.

A spiral-ribbed drillpipe 10 shown in FIG. 1 includes a pipe body 20 for use in a borehole and especially in a deviated or horizontal section of a borehole. Although the pipe body 20 can be composed of any suitable material such as steel or the like, the pipe body 20 is preferably composed of a light alloy, such as an aluminum alloy.

To couple the drillpipe 10 to other pipe or conduit, such as another drillpipe 10, a conventional steel drillpipe, a drill collar, etc., tool joints 40A-40B couple to the body's ends 22A-22B. In particular, tool joint 40A having thread 42A threads onto upper pin joint 23A, while tool joint 40B having thread 42B threads onto lower pin joint 23B. With tool joint 40A on end 22A, the cylindrical surface under the tool joint 40A provides an area to accommodate a casing spider and elevator for handling the drillpipe 10.

To deal with slime/sediment accumulation in a borehole, the pipe's intermediate portion 30 defines a plurality of ribs 32 extending along a length of the intermediate portion 30, although only one such rib 32 may be used in some implementations. Preferably, the ribs 32 have a right-handed twist and spiral along the intermediate portion 30, but a left-handed twist can also be used in some implementations. Likewise, the ribs 32 need not be spiraling and may in some implementations extend straight along the length of the intermediate portion.

Figure 2:
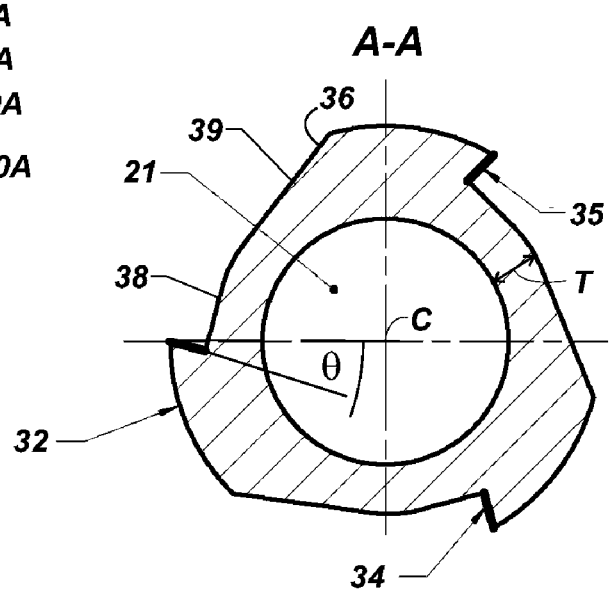
FIG. 2 is a cross-sectional view of the drillpipe of FIG. 1 along A-A showing a profile of ribs on the drillpipe.

Details of the ribs 32 are best shown in the cross-section of FIG. 2. Each rib 32 has an active face 34 exposed by a recessed area 36 defined in the body's generally cylindrical outer surface. To maintain the body 20's wall thickness T, these recessed areas 36 can have two angled surfaces 38 and 39, but a curved or even straight surface could be used. The rib's active faces 34 are generally perpendicular to the pipe body 20 (i.e., the faces 34 define a plane that is generally coplanar with the pipe's central axis C) but can slant inward or outward to an extent.

Preferably, however, one or more of the active faces 34 can be cut inward from perpendicular so that the active face 34 defines an angle relative to the pipe body's outer surface and effectively scoops and transports any slime/sediment in the borehole. In other words, the active face 34 can define an incut angle θ that does not intersect the pipe's central axis C. This incut angle θ may be about 0 to 20-degrees, although deviations from this angle could be used depending on the desired implementation. In addition, the active faces 34 preferably have wear-resistant coatings 35, which can be a fine-grained, high-strength coating of chrome alloy, for example. The outside surfaces of the spiral ribs 32 adjoining the active faces 34 can also be partially covered with the same wear-resistant coating. As will be discussed in more detail below, these ribs 32 with their active faces 34 and recessed areas 36 help to relieve slime/sediment accumulation that may occur in a deviated or horizontal section of a borehole.

To prevent the intermediate portion 30 from significantly engaging sidewalls in a deviated or horizontal section, first and second bearings 50A-50B rotatably position on the cylindrical surfaces adjacent the ends 22A-22B of the drillpipe 10. For wear resistance, these bearings 50A-50B are preferably composed of a steel material and hardened. Moreover, the bearings 50A-50B preferably have wear-resistant coating bands 52, which can be composed of Relit hard alloy, for example.

Figure 3:
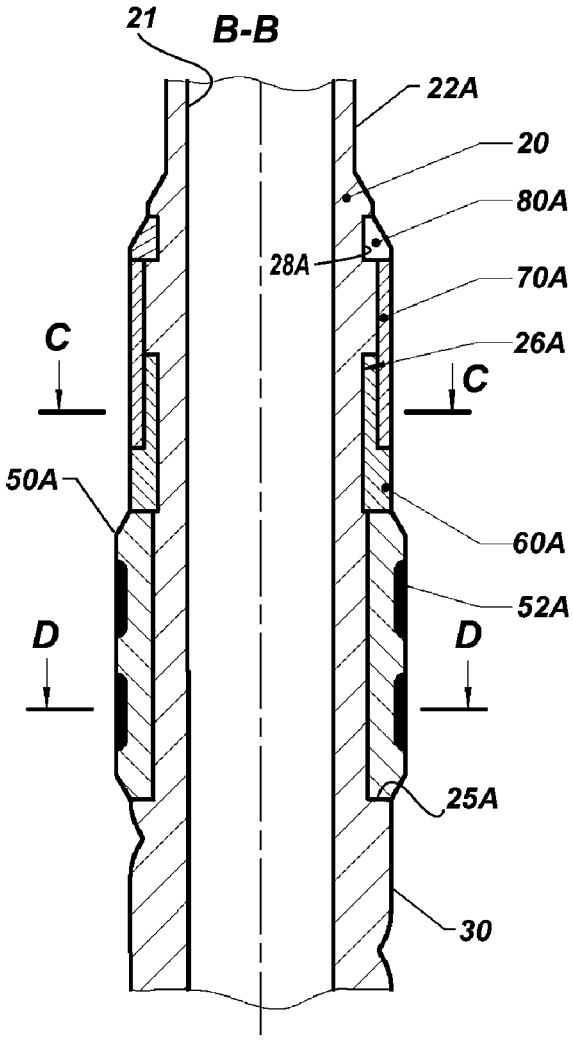
FIG. 3 is a longitudinal section view of the drillpipe along B-B showing a bearing installed on the drillpipe.
Figure 4:
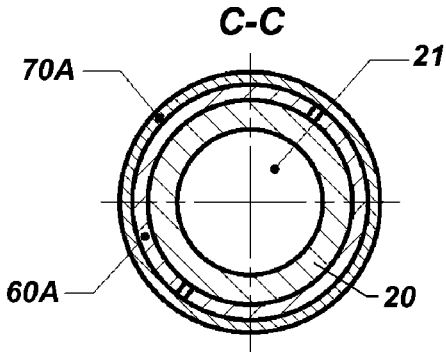
FIG. 4 is a cross-sectional view of the drillpipe along C-C showing features for retaining the bearing on the drillpipe.
Figure 5:
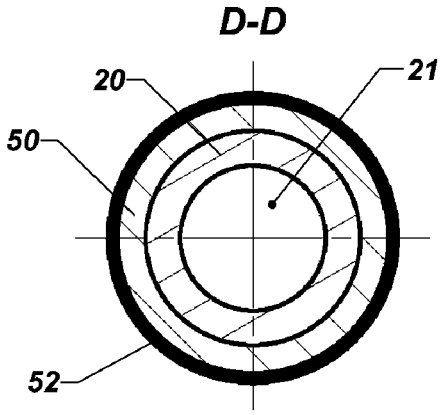
FIG. 5 is a cross-sectional view of the drillpipe along D-D showing features of the bearing.

FIG. 3 details how the bearings 50A-50B can be held on the pipe body 20. Although retention of only the first bearing 50A is shown, the same features can be used for the second bearing (50B; FIG. 1) as well. To retain the bearing 50A, it first positions over the pipe body's cylindrical surface 22A and against a shoulder 25A of the intermediate portion 30. Next, a split ring 60A disposes in a grooved area 26A and retains the bearing 50A against the shoulder 25A. Then, a retaining bushing 70A disposes partly on the spit split ring 60A and partly the pipe body 20 to retain the split ring 60A. Finally, a spring ring 80A disposes within a cylindrical groove 28A on the pipe body 20 and retains the retaining bushing 70A in position.

As shown in FIG. 1, the drillpipe's bearings 50A-50B as well as the other components have diameters configured to handle issues with wear and slime/sediment accumulation in deviated or horizontal sections of a borehole. In particular, the bearings 50A-50B have a diameter $D_B$ that is greater than the intermediate portion's diameter $D_P$ and is greater than the tool joints' diameter $D_J$. The larger diameter $D_B$ allows the bearings 50A-50B to engage the sidewalls of the borehole in which the drillpipe 10 positions. This relieves potential wear on the tool joints 40A-40B and the pipe's intermediate portion 30, yet still allows the ribs 32 to engage slime and sediment along the borehole wall.

Figure 6:
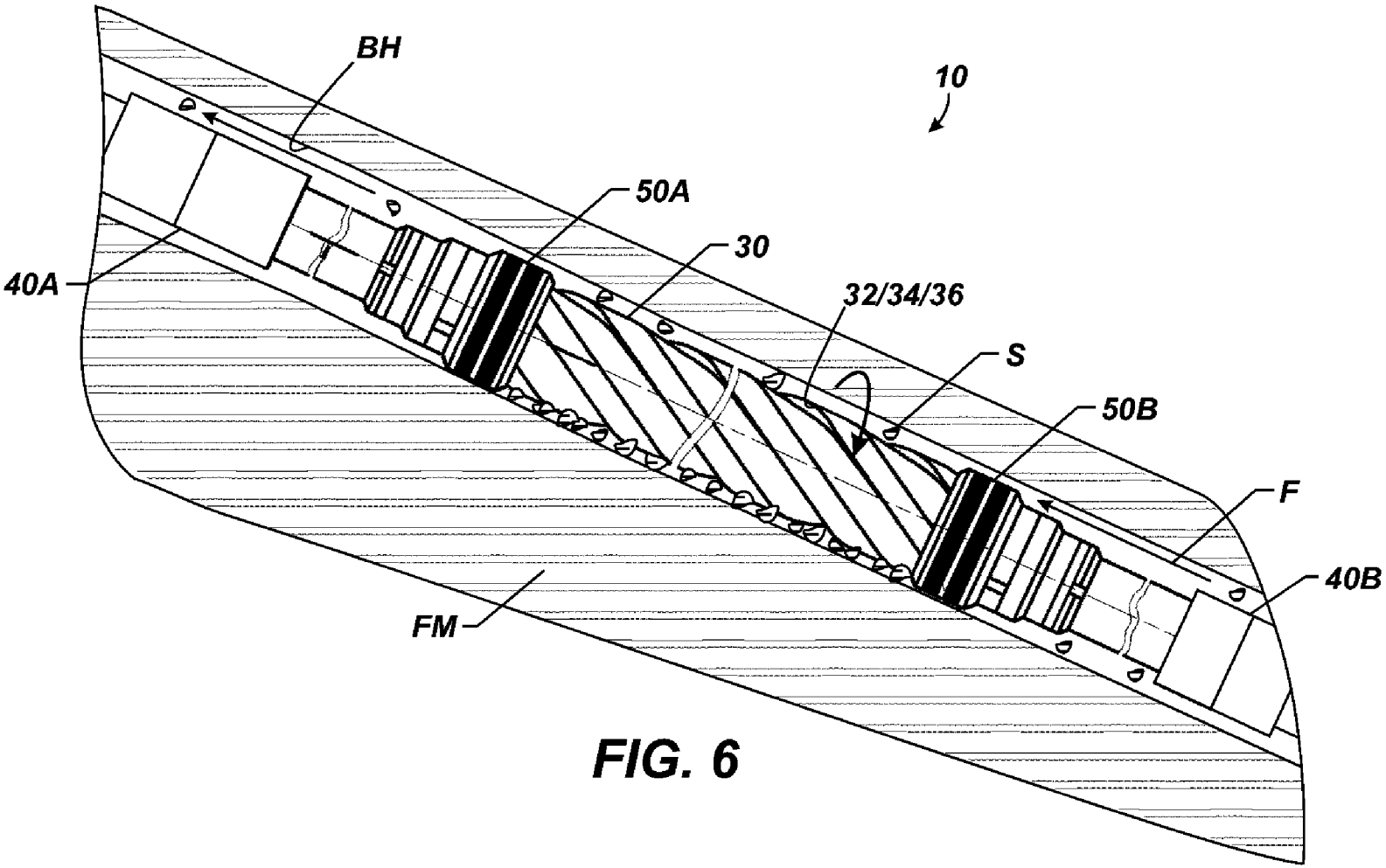
FIG. 6 shows the disclosed drillpipe deployed in a deviated section of a borehole.

Use of the drillpipe 10 in a deviated or horizontal section of a borehole BH is illustrated in FIG. 6. To use the drillpipe 10, operators first install a plurality of the drillpipes 10 on a drillstring using the tool joints 40A-40B. As an example, the drillstring for drilling a deviated section can include a bottomhole assembly (e.g., drill bit, motor, etc.) and drill collars followed by a section having the disclosed drillpipes 10 (about 200-250 m) using about 400 or more tool joint connections and then followed by another section having steel drillpipes.

When the drillstring is deployed downhole and drills through a formation FM, operators inject drilling mud through the drillstring to the bottomhole. This injected drilling mud passes through the pipe's internal bore 21 and activates the downhole motor, cools the drilling bit, and removes drilling cuttings through annulus to the surface. The spiraling ribs 32 and their corresponding active faces 34 and recessed areas 36 reduce the probability that the drillpipe 10 will stick in the borehole under differential pressure (difference between reservoir pressure and hydrostatic pressure in the hole). Moreover, the bearings 50A-50B help stabilize the bottomhole assembly because the drillpipe 10's overall outside diameter has a reduced clearance with the borehole wall.

As expected, however, drilling in the deviated section with high inclination (over 65 degrees) causes drilling cuttings and slime/sedimentation S to accumulate along the lower wall of the borehole BH. The accumulation may especially occur during a "sliding mode" of operation when the drill string is not rotating and is being moved to correct the well trajectory. In any event, the accumulation inhibits the drillstring's movement and rotation and may eventually lead to the drillstring sticking in the borehole BH.

The drillpipe 10 alleviates the problems caused by slime/sediment S by helping to clear the accumulation from the borehole BH and reduce the resistance experienced during operation. When the drillpipe 10 is rotating, for example, the intermediate portion 30's right-hand spiraling ribs 32 repeatedly interact with the slime/sediment accumulated on the borehole BH's lower wall. In this repeated interaction, the active faces 34 on the rib's leading edges scoop up the slime/sediment and transports it to the borehole BH's upper side where the typical upflow F of drilling mud can then carry the slime/sediment S uphole. With the right-hand spiraling, any engaged slime/sediment material can also be moved axially along the length of the drillpipe 10. This clearing of accumulated slime and sediment may allow operators to reduce the mud flow required during drilling, which in itself can produce a better value for the equivalent circulation density (ECD).

While the drillpipe 10 rotates, the bearings 50A-50B on the pipe 10 contact the borehole BH's walls. Being rotatable on the drillpipe 10, the bearings 50A-50B experience less revolutions than experienced by the pipe body 20. Accordingly, the bearing 50A-50B's reduced revolutions along with their anti-wear coatings 52 prolong their service life and reduce the torque required to rotate the drillpipe 10. Because the bearing's diameter $D_B$ (See FIG. 1) is greater than the diameters of the tool joints 40A-40B and the pipe body 20, surface wear on the tool joint 40A-40B and the pipe body 20 can also be reduced, which increases their operational life as well.

As noted previously, the drillpipe 10 is preferably composed of a lightweight alloy, such as aluminum alloy. Examples of suitable aluminum alloys include D16T (Russian standard GOST 4748) of the Al—Cu—Mg system or 1953 T1 of the Al—Zn—Mg system, although other suitable aluminum alloys for the wellbore environment may also be used. Compared with conventional steel pipes, the drillpipe 10 made from the lightweight alloy can reduce friction and resistance forces while moving and rotating the drillstring. In addition, the aluminum drillpipe 10 can be manufactured by extrusion so that different configurations and profiles for the spiraling ribs 32, active faces 34, and recessed areas 36 can be produced without the need for much machining, if any.

Being composed of aluminum alloy or the like, the drillpipe 10 preferably meets the ISO 15546 requirements for physical and mechanical properties after heat treatment and ageing. To further meet ISO 15546, the tool joints 40A-40B used to interconnect the drillpipe 10 are preferably composed of steel. In addition, the connections between tool joints 40A-40B and the drillpipe's ends 22A-22B preferably have tapered threads with a thread cross-section that is trapezoidal, and the connections preferably use tapered shoulders and internal stops to relieve some of the thread loads.

For some exemplary dimensions, the overall length of the drillpipe 10 can be about 9000-mm to about 12200-mm, with the drillpipe's ribbed intermediate portion 30 being about 105 to 200-mm. Diameters and wall thicknesses of the drillpipe 10 depend in part on the length of the drillpipe 10, the desired internal bore diameter, desired pipe size, etc. In general and with reference to FIG. 1, the tool joints 40A-40B can have an outside diameter $D_J$ of about 108-mm to about 203-mm. The drillpipe's ribbed intermediate portion 30 can have an outer diameter $D_P$ of about 90-mm to about 170-mm (or more to be greater than the tool joint diameter $D_J$) with an internal diameter of about 70-mm to about 150-mm or more. The pipe body's wall thickness, therefore, can be about 9-mm to about 22-mm. The bearings 50A-50B can have a diameter $D_B$ slightly larger than the intermediate portion's diameter $D_P$ and the tool joints diameter $D_J$ to be greater than these diameters and can, for example, have diameters of about 114-mm to 208-mm.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A drillpipe, comprising:

a unitary pipe body having an outer surface, first and second ends connectable to drillstring elements, and an intermediate portion disposed between the first and second ends, the intermediate portion having at least one rib disposed along the outer surface, the rib having a face being substantially perpendicular to the outer surface and being engageable with material adjacent a borehole wall;

a first bearing rotatably disposed on the unitary pipe body adjacent the first end and being engageable with the borehole wall, the first bearing haying a first edge restrained by a first shoulder on the unitary pipe body;

a first retainer disposed on the unitary pipe body between the first end and the first bearing and restraining a second edge of the first bearing;

a second bearing rotatably disposed on the unitary pipe body adjacent the second end and being engageable with the borehole wall, the second bearing having a first edge restrained by a second shoulder on the unitary pipe body; and a second retainer disposed on the unitary pipe body between the second end and the second bearing and restraining a second edge of the second bearing.

2. The drillpipe of claim 1, wherein the unitary pipe body comprises an aluminum alloy material, and wherein the first and second bearings comprise a steel material.

3. The drillpipe of claim 1, wherein each of the first and second bearings has an outer surface comprising a wear-resistant coating.

4. The drillpipe of claim 1, wherein each of the first and second bearings defines a first outer diameter that is greater than a second outer diameter of the intermediate portion.

5. The drillpipe of claim 4, wherein first and second joints dispose on the first and second ends of the unitary pipe body, and wherein the first outer diameter is greater than a third outer diameter of the first and second joints.

6. The drillpipe of claim 1, wherein the first and second retainers comprise first and second split rings disposed on the unitary pipe body and retaining the first and second bearings against the first and second shoulders.

7. The drillpipe of claim 6, wherein the first and second retainers comprise first and second retaining bushings disposed on the unitary pipe body and retaining the first and second split rings.

8. The drillpipe of claim 7, wherein the first and second retainers comprise first and second spring rings disposed on the unitary pipe body and retaining the first and second retaining bushings.

9. The drillpipe of claim 1, wherein the at least one rib has a right-handed twist as it spirals along the intermediate portion, whereby the engaged material is moveable along the unitary pipe body.

10. The drillpipe of claim 1, wherein the face defines an incut angle that does not intersect a central axis of the unitary pipe body.

11. The drillpipe of claim 1, wherein a recessed area in the outer surface of the intermediate portion exposes the face, the recessed area having at least two angled sides on the outer surface maintaining a wall thickness of the intermediate portion.

12. The drillpipe of claim 1, wherein the face comprises a wear-resistant coating.

13. A drillpipe, comprising:

a unitary pipe body having an outer surface and first and second ends having male threads connectable to female threads of drillstring joints, the unitary pipe body having a first portion adjacent the first end, a second portion adjacent the second end, and an intermediate portion disposed between the first and second portions and defining first and second shoulders therewith, the intermediate portion having a plurality of ribs spiraling along the outer surface, each rib having a face exposed by a recessed area in the outer surface, each face being substantially perpendicular to the outer surface and being engageable with material adjacent a borehole wall;

a first bearing rotatably disposed on the first portion adjacent the first shoulder, the first bearing having a first edge restrained by the first shoulder;

a first retainer disposed on the unitary pipe body between the first end and the first bearing and restraining a second edge of the first bearing;

a second bearing rotatably disposed on the second portion adjacent the second shoulder, the second bearing having a first edge restrained by the second shoulder; and a second retainer disposed on the unitary pipe body between the second end and the second bearing and restraining a second edge of the second bearing, wherein the first and second bearings define a first outer diameter greater than a second outer diameter of the intermediate portion, whereby the first and second bearings are engagable with the borehole wall.

14. The drillpipe of claim 13, wherein the unitary pipe body comprises an aluminum alloy material, and wherein the first and second bearings comprise a steel material.

15. The drillpipe of claim 13, wherein each of the first and second bearings has an outer surface comprising a wear-resistant coating.

16. The drillpipe of claim 13, wherein each of the ribs has a right-handed twist as it spirals along the intermediate portion, whereby the engaged material is moveable along the unitary pipe body.

17. The drillpipe of claim 13, wherein one or more of the faces defines an incut angle in the outer surface such that the face does not intersect a central axis of the unitary pipe body.

18. The drillpipe of claim 13, wherein each of the recessed areas has at least two angled sides on the outer surface maintaining a wall thickness of the intermediate portion.

19. The drillpipe of claim 13, wherein each of the faces comprises a wear-resistant coating.

20. The drillpipe of claim 13, wherein the first outer diameter is greater than a third outer diameter of the drillstring joints.

21. The drillpipe of claim 13, wherein the first and second retainers comprise first and second split rings disposed on the unitary pipe body and retaining the first and second bearings against the first and second shoulders.

22. The drillpipe of claim 21, wherein the first and second retainers comprise first and second retaining bushings disposed on the unitary pipe body and retaining the first and second split rings.

23. The drillpipe of claim 22, wherein the first and second retainers comprise first and second spring rings disposed on the unitary pipe body and retaining the first and second retaining bushings.

* * * * *

UNITED STATES PATENT AND TRADEMARK OFFICE

CERTIFICATE OF CORRECTION

PATENT NO. : 7,814,996 B2
APPLICATION NO. : 12/103061
DATED : October 19, 2010
INVENTOR(S) : David Indrupskiy It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 115 days.

Signed and Sealed this
Tenth Day of May, 2011

David J. Kappos

David J. Kappos
*Director of the United States Patent and Trademark Office*